US011013337B2

(12) United States Patent
Wu

(10) Patent No.: US 11,013,337 B2
(45) Date of Patent: May 25, 2021

(54) THERAPEUTIC PILLOW

(71) Applicant: Guanhao Wu, Jersey City, NJ (US)

(72) Inventor: Guanhao Wu, Jersey City, NJ (US)

( * ) Notice: Subject to any disclaimer, the term of this patent is extended or adjusted under 35 U.S.C. 154(b) by 129 days.

(21) Appl. No.: 16/532,765

(22) Filed: Aug. 6, 2019

(65) Prior Publication Data

US 2021/0037985 A1 Feb. 11, 2021

(51) Int. Cl.

| | |
|---|---|
| ***A47C 20/02*** | (2006.01) |
| ***A47G 9/10*** | (2006.01) |
| ***A63B 21/00*** | (2006.01) |
| ***A61G 13/12*** | (2006.01) |
| ***A61G 13/00*** | (2006.01) |

(52) U.S. Cl.

CPC ..... *A47C 20/027* (2013.01); *A47G 9/10* (2013.01); *A47G 9/1072* (2013.01); *A47G 9/1081* (2013.01); *A61G 13/009* (2013.01); *A61G 13/121* (2013.01); *A61G 13/1225* (2013.01); *A61G 13/1245* (2013.01); *A63B 21/4037* (2015.10)

(58) Field of Classification Search

CPC ..... A47C 20/027; A47G 9/10; A47G 9/1072; A47G 9/1081; A61G 13/1245; A61G 13/121; A61G 13/009; A61G 13/1225; A63B 21/4037

See application file for complete search history.

(56) References Cited

U.S. PATENT DOCUMENTS

| | | | | |
|---|---|---|---|---|
| 3,843,980 | A * | 10/1974 | Rodriguez | A47C 20/021 5/733 |
| 4,840,362 | A * | 6/1989 | Bremer | A61G 13/12 5/621 |
| 5,448,790 | A * | 9/1995 | Saro | A47C 17/045 5/427 |
| 6,154,903 | A * | 12/2000 | Wai-Chung | A47C 20/026 5/632 |
| 6,874,183 | B1 * | 4/2005 | Taylor | A47C 20/021 5/630 |
| 8,074,310 | B1 * | 12/2011 | Robbins | A47C 20/025 5/632 |
| 9,155,399 | B1 * | 10/2015 | Zenoff | A47C 20/023 |
| 10,448,746 | B2 * | 10/2019 | Galloway | A47D 15/008 |
| 10,758,442 | B2 * | 9/2020 | Panigada | A61G 7/0755 |

(Continued)

*Primary Examiner* — Robert G Santos
*Assistant Examiner* — Rahib T Zaman
(74) *Attorney, Agent, or Firm* — Michael J. Feigin, Esq.; Feigin and Fridman LLC

(57) ABSTRACT

A therapeutic pillow is disclosed. The therapeutic pillow provides support to a user's head, neck, back, and spine when lying down on the pillow. The pillow includes a head support, an elongated spine support, a firm support member for supporting the elongated spine support, and a lower member for manipulating the pillow. When lying down on the pillow the force exerted onto the elongated spine support compresses the elongated spine support. This compression causes an end of the elongated spine support that is connected to the head support to bend, which in turn causes the head support to bend at an angle towards the vertical axis of the pillow. Further, when lying on the pillow the lower member protrudes through a user's legs, which enables users to grasp the lower member with their legs and perform therapeutic exercises with the pillow.

20 Claims, 3 Drawing Sheets

(56) References Cited

U.S. PATENT DOCUMENTS

| | | | | |
|---|---|---|---|---|
| 2004/0226096 | A1* | 11/2004 | Davis | A47C 20/027 5/632 |
| 2009/0229048 | A1* | 9/2009 | Maganov | A63B 21/4037 5/420 |
| 2010/0078033 | A1* | 4/2010 | Aikman | A61G 7/065 128/845 |
| 2012/0266894 | A1* | 10/2012 | Pi | A61G 13/1235 128/845 |
| 2014/0174452 | A1* | 6/2014 | Reaves | A47G 9/10 128/845 |
| 2018/0133541 | A1* | 5/2018 | Cooper | A63B 21/0552 |
| 2019/0200774 | A1* | 7/2019 | Tacon | A47C 20/027 |
| 2019/0262659 | A1* | 8/2019 | Jagessar | A47G 9/1081 |
| 2019/0365553 | A1* | 12/2019 | Drivere | A61F 5/01 |
| 2020/0215378 | A1* | 7/2020 | Conklin | A63B 22/0285 |
| 2020/0337479 | A1* | 10/2020 | Zurek | A47G 9/109 |

* cited by examiner

THERAPEUTIC PILLOW

FIELD OF THE DISCLOSED TECHNOLOGY

The disclosed technology relates to a therapeutic pillow, more specifically, to a therapeutic spine and back pillow that provides added support to a user's spine while laying thereon in a supine position and includes a lower leg member for aiding in the performance of therapeutic exercises using the pillow.

BACKGROUND OF THE DISCLOSED TECHNOLOGY

It has long been recognized that it is desirable to support the entirety of a person's back as well as their head and neck when lying down. Many beds are inadequate in that they do not support a person's back over a period of time. Though, Bolster pillows and cylindrical and semi-cylindrical lumbar and cervical support cushions have been available for some time, they are lacking in that they are not directed to a person's neck, head, and the entirety of a person's back. Moreover, they are lacking in that they do not have a manipulatable component that enables a user to perform therapeutic back exercises. Various therapeutic and/or orthopedic pillows have been developed to provide support to a person's spine, neck, and/or lower back, but none provide support to a user's head, neck, and back all at once and provide a manipulatable component for performing therapeutic back exercises.

Accordingly, there is a need for a therapeutic pillow which provides support to user's neck and entire spine and provides a component in which a user can manipulate to aid in the performance of therapeutic back exercises.

SUMMARY OF THE DISCLOSED TECHNOLOGY

Disclosed herein is a therapeutic pillow including a head support, an elongated spine support extending outwardly from the head support, a support member disposed on a surface of the elongated spine support, and a lower member extending perpendicularly outwardly from an end of the elongated spine support. The support member provides support to the elongated spine support. In embodiments, the elongated spine support is coplanar with the head support. In other embodiments, the head support, the elongated spine support, and the lower member each include a cushion or cushioning.

In embodiments, the therapeutic pillow includes a longitudinal axis, which extends through a center of a longitudinal length of the therapeutic pillow in a horizontal plane and a vertical axis extending through a center of the longitudinal length of the therapeutic pillow in a vertical plane. The horizontal plane is normal to the vertical plane. When a force is applied to the elongated spine support, the force compresses the elongated spine support between the force and the support member, which compression bends the head support at an angle towards the vertical axis of the therapeutic pillow.

In some embodiments, a force applied to the elongated spine support bends the elongated spine support along a middle section thereof, which in turn bends an end of the elongated spine support that is connected to the head support. This end of the elongated spine support bends at an angle towards the vertical axis of the therapeutic pillow, thereby bending the head support towards the vertical axis of the therapeutic pillow.

In embodiments, a force applied to the elongated spine support compresses the elongated spine support between the force and the support member, which compression bends the head support at an acute angle relative to either side of a point where the force most substantially compresses the elongated spine support.

In some embodiments, a force applied to the elongated spine support compresses the elongated spine support between the force and the support member, which compression bends the elongated spine support and the head support acutely towards each other substantially at a point where the elongated spine support and the head support join.

In embodiments, the head support includes a neck support protruding upwardly from a side of the head support that is attached to the elongated spine support. In one embodiment, the neck support defines an arch that arches away from the elongated spine support. In other embodiments, the head support is rectangular.

In some embodiments, the elongated spine support extends perpendicularly outwardly from a side of the head support. In one embodiment, the elongated spine support extends perpendicularly outwardly from the side of the head support that the neck support is disposed. In other embodiments, the elongated spine support includes a length greater than a length of the head support. In another embodiment, the elongated spine support is triangular.

In embodiments, the support member is a rigid member that provides a rigid support to the elongated spine support when a force is applied to the elongated spine support. In one embodiment, the support member is coextensive with the surface of the elongated spine support. In some embodiments, the lower member is pivotally connected to the elongated spine support. In one embodiment, the lower member is pivotal about a longitudinal axis of the elongated spine support. In other embodiments, the lower member is resilient about the elongated spine support, such that the lower member returns to its perpendicularly outward orientation after being pivoted. In one embodiment, the lower member is rectangular. In another embodiment, the lower member includes an arching portion disposed on a distal end thereof, the arching portion including an arch that arches outwardly from the lower member.

For purposes of this disclosure, the following definitions are used. "Resilient" refers returning to the original form or position after being bent, compressed, or stretched, flexed, and/or moved from its original form or position. "Rigid" refers to stiff or unyielding, or deficiently flexible, or hard. "External" refers to situated or being outside something. "Coextensive" refers to equal or coincident in space or having the same spatial boundaries. "Bow" refers to cause to incline or angle, or to something bent into a simple incline, curve, or arc. "Bias" refers to the inclination of an object, thing, item, or component to return to its original position after being moved therefrom.

Any device or step to a method described in this disclosure can comprise or consist of that which it is a part of, or the parts which make up the device or step. The term "and/or" is inclusive of the items which it joins linguistically and each item by itself. "Substantially" is defined as at least 95% of the term being described and/or "within a tolerance level known in the art and/or within 5% thereof. Any device or aspect of a device or method described herein can be read as "comprising" or "consisting" thereof.

DETAILED DESCRIPTION OF EMBODIMENTS OF THE DISCLOSED TECHNOLOGY

The present disclosed technology provides a therapeutic pillow including a head support and an elongated spine support having a support member for providing added support to a user's spine while lying on the therapeutic pillow in a supine position. The therapeutic pillow further provides a lower member for manipulation by a user's legs to aid in the performance of therapeutic exercises while lying down on the therapeutic pillow in the supine position.

Embodiments of the disclosed technology will become clearer in view of the following description of the figures.

Figure 1:
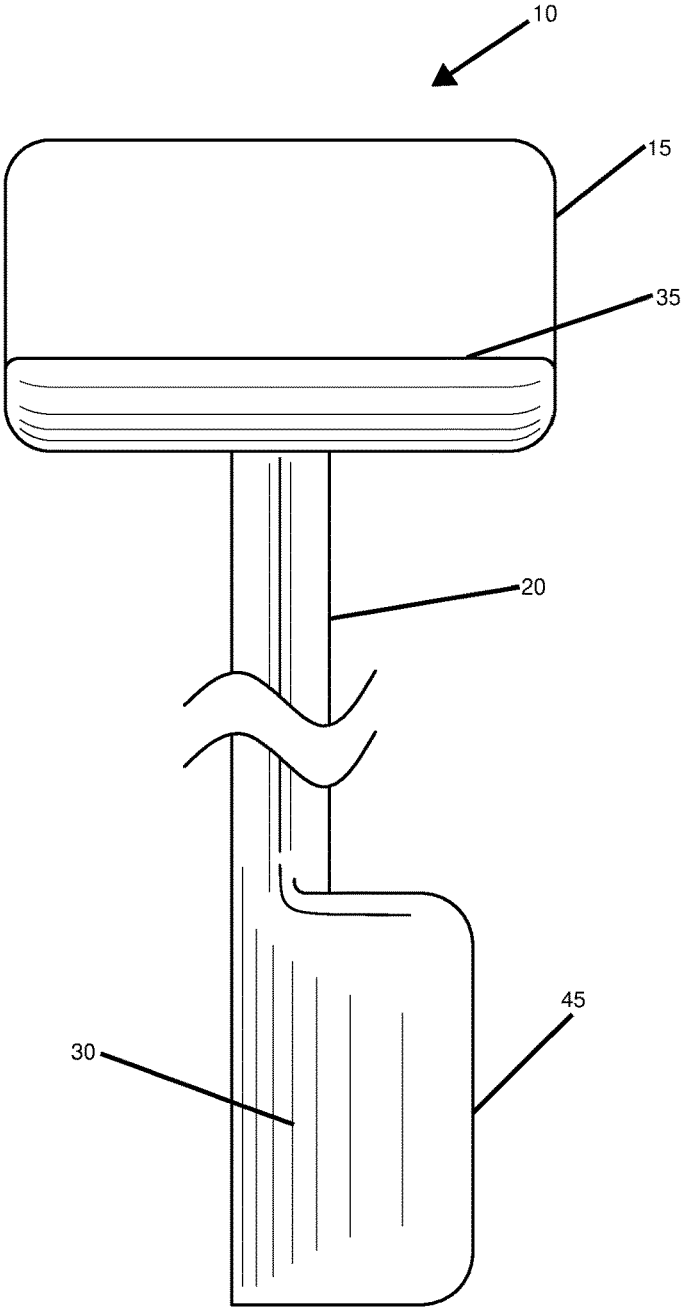
FIG. 1 shows a top plan view of the therapeutic pillow according to one embodiment of the present invention.
Figure 2:
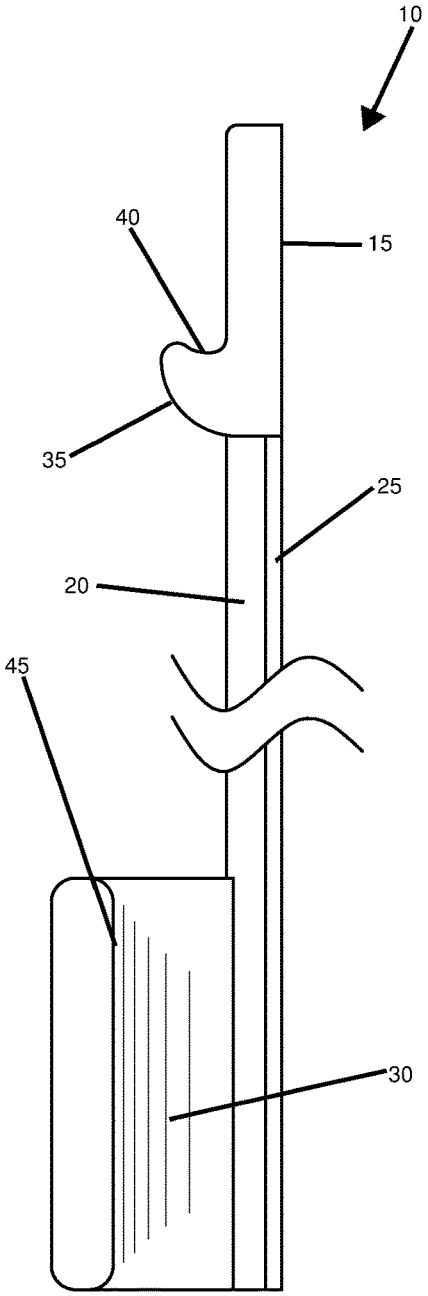
FIG. 2 shows a side view of the therapeutic pillow according to one embodiment of the present invention.
Figure 3:
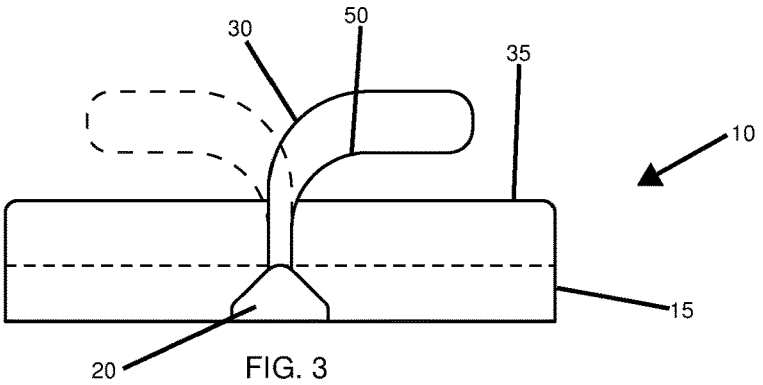
FIG. 3 shows a bottom view of the therapeutic pillow according to one embodiment of the present invention.

Referring now to FIGS. 1-3, simultaneously, FIG. 1 shows a top plan view of the therapeutic pillow according to one embodiment of the present invention. FIG. 2 shows a side view of the therapeutic pillow according to one embodiment of the present invention. FIG. 3 shows a bottom view of the therapeutic pillow according to one embodiment of the present invention. The therapeutic pillow 10 includes a head support 15, an elongated spine support 20, a support member 25, and a lower member 30. The therapeutic pillow 10 includes a horizontal axis extending through a center of a longitudinal length of the therapeutic pillow in a horizontal plane and a vertical axis extending through a center of the longitudinal length of the therapeutic pillow in a vertical plane. The horizontal axis of the therapeutic pillow 10 is normal to the vertical axis of the therapeutic pillow 10.

The head supports 15 provides support to the head of a user that is lying on the therapeutic pillow 10 in a supine position. The elongated spine support 20 provides support to the spine of a user that is lying on the therapeutic pillow 10 in the supine position. The support member 25 provides a firm support structure for the elongated spine support 20 and the spine of a user that is lying on the therapeutic pillow 10 in the supine position. The support member 25 helps the elongated spine support 20 bear the weight or force of a user that is applied to the elongated spine support 20 when the user is lying on the therapeutic pillow 10 in a supine position. The lower member 30 provides a point of manipulation of the therapeutic pillow 10 by a user that is lying on the therapeutic pillow 10 in a supine position. The user may manipulate the therapeutic pillow 10 via the lower member 30 by grasping, clutching, or squeezing the lower member 30 with his or her legs and moving the lower member 30 therewith. In embodiments, the head support 15, the elongated spine support 20, and the lower member 30 each include a cushion or provide cushioning for providing comfort and support to a user's head, neck, and back when the user is lying on the therapeutic pillow 10 in the supine position.

The head support 15 extends outwardly from an end of the elongated spine support 20. In embodiments, the head support 15 includes a neck support 35 for providing added support and comfort to a user's head. In one embodiment, the neck support 35 protrudes upwardly from a side of the head support 15. The neck support 35 defines an arch 40 that arches away from the elongated spine support 20. In one embodiment, the neck support 35 protrudes upwardly from the side of the head support 15 that is attached to the elongated spine support 20. In some embodiments, the head support 15 is rectangular.

The elongated spine support 20 extends outwardly from the head support 15 and is coplanar with the head support 20. In embodiments, the elongated spine support 20 extends perpendicularly outwardly from a side of the head support 15. In some embodiments, the elongated spine support 20 extends perpendicularly outwardly from a side of the head support 15. In one embodiment, the elongated spine support 20 includes a length greater than a length of the head support 15. In another embodiment, the elongated spine support 20 is sized to extend from a user's neck area to below a user's waist area. In this way, the entirety of a user's spine is supported by the therapeutic pillow 10 when the user is lying on the therapeutic pillow 10 in a supine position. In some embodiments, the elongated spine support 20 is triangular in shape, in which a vertex of the triangle shaped elongated spine support 20 is oriented along the vertical axis of the therapeutic pillow 10 such that when a user is lying on the therapeutic pillow 10 in a supine position, the vertex provides a pressure point and/or cushion to the user's spine.

The support member 25 is disposed on a surface of the elongated spine support 20. The support member 25 provides a firm support structure for the elongated support 20. In embodiments, the support member 25 is disposed on the surface of the elongated spine support 20 that is opposite the surface of the elongated spine support 20, which a user's back contacts when the user is lying on the therapeutic pillow 10 in a supine position. In some embodiments, the support member 25 is a rigid member comprising a rigid material such as plastic, metal, or wood. In other embodiments, the support member 25 is a semi-rigid member comprising a semi-rigid material such as other rubber that enables the support member 25 to bend within a close tolerance. In embodiments, the support member 25 is coextensive with the surface of the elongated spine support 20, such that it spans the entire surface of the elongated spine support 20, thereby providing adequate support thereto.

The lower member 30 is disposed on an end of the elongated spine support 20 that is opposite the end of the elongated spine support 20 on which the head support 15 is disposed. In embodiments, the lower member 30 extends perpendicularly outwardly from the elongated spine support 20 along the vertical axis of the therapeutic pillow. In some embodiments, the lower member 30 is pivotally connected to the elongated spine support 20 such that it may rotate about a longitudinal axis of the elongated spine support 20, or the horizontal axis of the therapeutic pillow 10, as shown in FIG. 3. In one embodiment, the lower member 30 is substantially resilient about the elongated spine support 20, such that the lower member 30 substantially returns to its original orientation after being pivoted about the longitudinal axis of the elongated spine support 20. In this way, the lower member 30 is biased towards its original orientation when pivoted from its original orientation and is inclined to return to its original orientation after being pivoted, making it easier to manipulate when using. In one embodiment, the lower member 30 is rectangular and has planar surfaces so as to provide a surface area in which a user can easily manipulate, e.g., grasp, clutch, or squeeze with his or her legs, and move about the elongated spine support 20. In another embodiment, the lower member 30 includes an arching portion 45 disposed on a distal end thereof. The arching portion 45 provides a user an area in which to further help grasp the lower member 30 and manipulate the lower member 30. The arching portion includes an arch 50 that arches or extends outwardly and/or away from the lower member 30.

Figure 4:
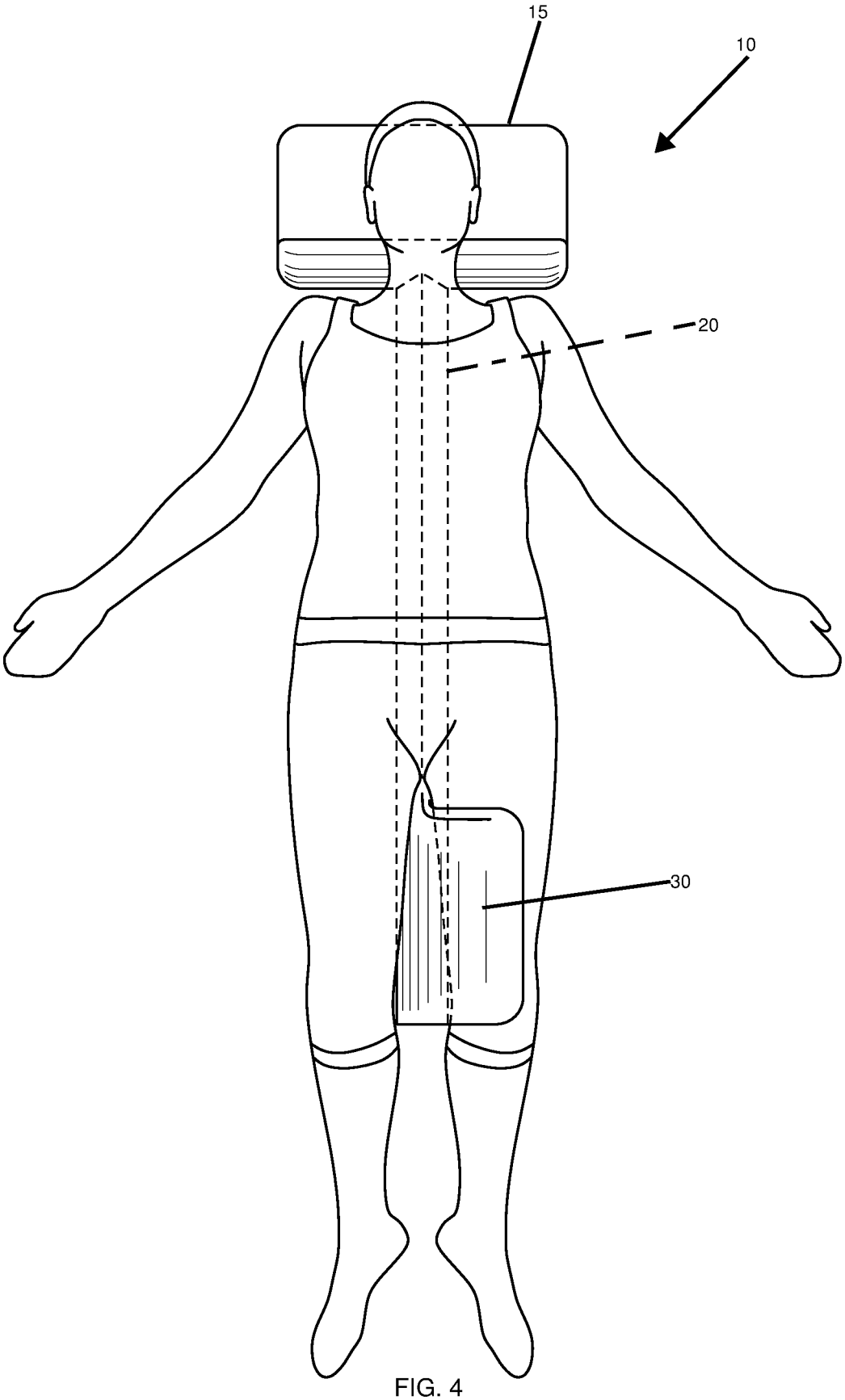
FIG. 4 shows a top plan view of the therapeutic pillow in use according to one embodiment of the present invention.
Figure 5:
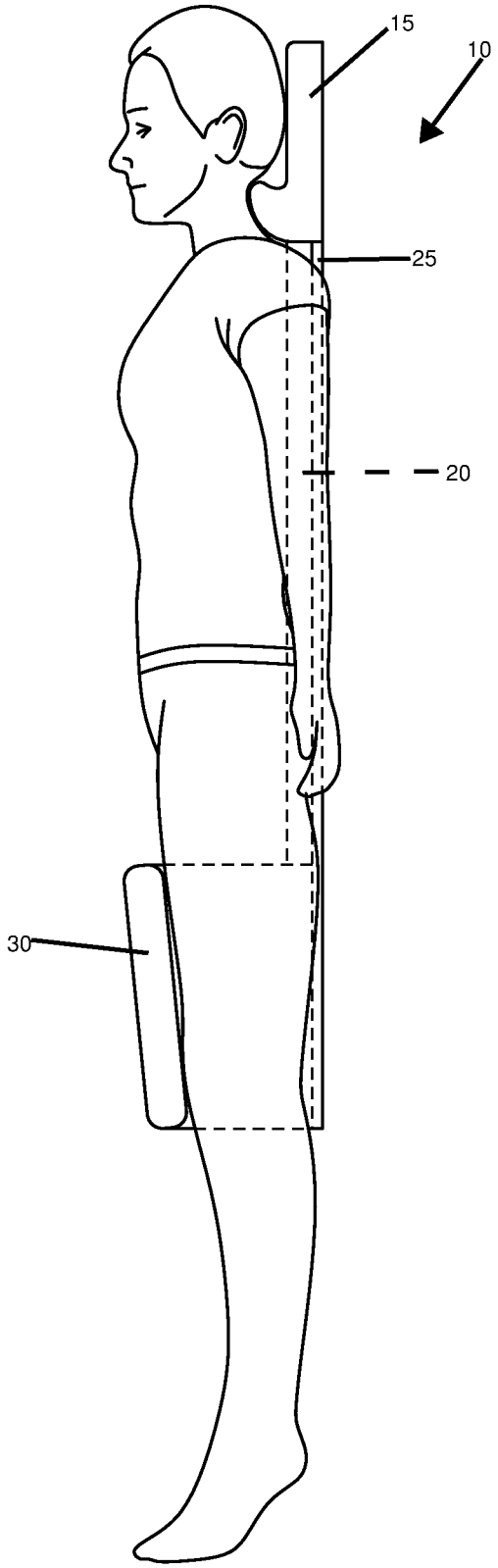
FIG. 5 shows a side view of the therapeutic pillow in use according to one embodiment of the present invention.
Figure 6:
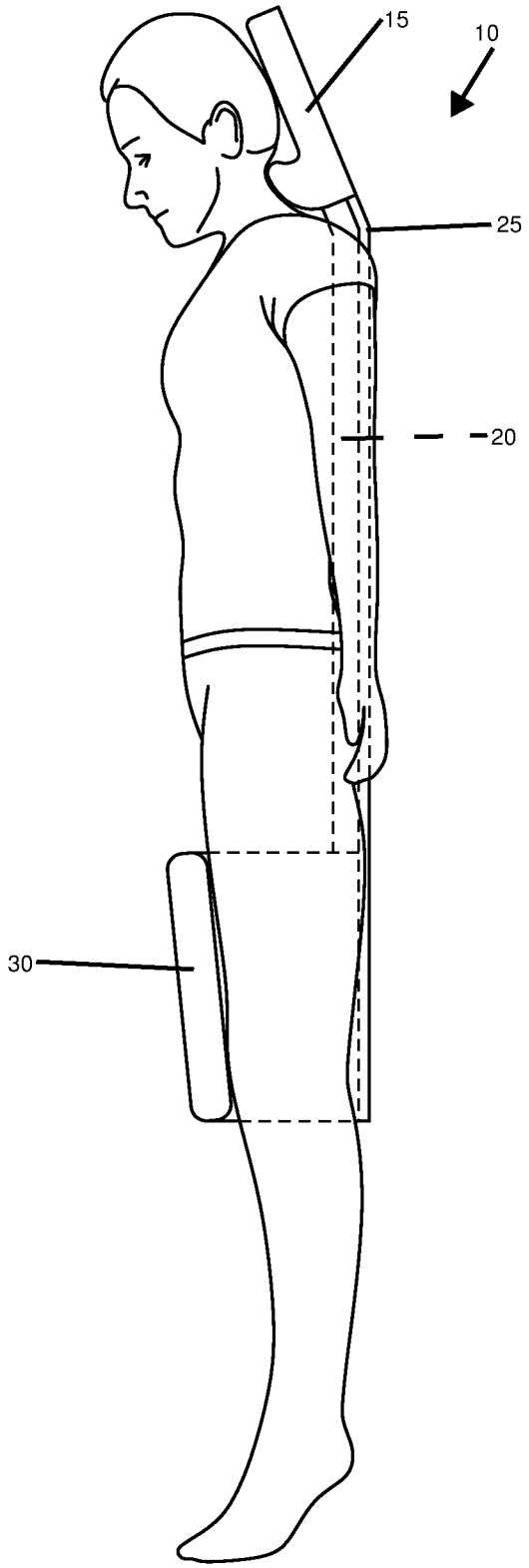
FIG. 6 shows a side view of the therapeutic pillow in use and operating to provide support to a user's neck according to one embodiment of the present invention.

Referring now to FIGS. 4-6 simultaneously, FIG. 4 shows a top plan view of the therapeutic pillow in use according to one embodiment of the present invention. FIG. 5 shows a side view of the therapeutic pillow in use according to one embodiment of the present invention. FIG. 6 shows a side view of the therapeutic pillow in use and operating to provide support to a user's neck according to one embodiment of the present invention.

In operation, a user lies on the therapeutic pillow 10 in a supine position. When lying down on the therapeutic pillow 10, the force exerted onto the elongated spine support 20 by the user's weight compresses the elongated spine support 20 between the user and the support member 25. In embodiments, the force applied to the therapeutic pillow 10 by the user is strongest along a middle section of the elongated spine support 20. The compressive force applied to the middle section of the elongated spine support 20 translates to the support member 20, which force causes the ends of the support member 20 to bow towards the vertical axis of the therapeutic pillow 10. The bowing of the support member 20 causes the ends of the elongated spine support 20 to bend or bow along with the ends of the support member 20. Since the elongated spine support 20 is attached to the head support 15, the elongated spine support 20 in turn causes the head support 15 to bend at angle towards the vertical axis of the therapeutic pillow 10 or towards the user's neck, thereby providing added support to the user's neck when lying on the therapeutic pillow 10 in the supine position. For example, the compressive force bends the head support 15 at an acute angle relative to either side of a point where the force of a user's weight most substantially compresses the elongated spine support 20. The compressive force bends the elongated spine support 20 and the head support 15 acutely towards each other substantially at a point where the elongated spine support 20 and the head support 15 are joined.

When lying on the therapeutic pillow 10 in the supine position, the lower member 30 protrudes through a user's legs. In this way, a user can grasp, clutch, and/or squeeze the lower member 30, thereby enabling the user to manipulate the lower member 30 with his or her legs. Manipulation of the lower member 30 enables the user to perform therapeutic exercises on the therapeutic pillow 10, for example, by rolling the lower member 30, back and forth, or side to side, and up and down, about the longitudinal axis of the elongated spine support 20.

In other operations, a user employs the therapeutic pillow 10 with a softer bed. The user places the therapeutic pillow 10 onto the bed and lies on the therapeutic pillow 10 in a supine position. Utilizing the therapeutic pillow 10 while on a softer bed helps align the user's spine and shoulders that would otherwise be unaligned without the therapeutic pillow 10. When lying on the therapeutic pillow 10 the elongated spine support 20 and the head support 20 bend as described above. This bending raises the spine of the user and lowers the shoulders of the user while the user is lying down on the pillow in a supine position, thereby aligning the user's back and providing added comfort to the user while lying on a soft bed in the supine position.

The present technology can be carried out with one or more of the embodiments described. The drawings show embodiments with the understanding that the present description is to be considered an exemplification of the principles and is not intended to be exhaustive or to limit the disclosure to the details of construction. The arrangements of the components are set forth in the following description or illustrated in the drawings.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described herein-above are also contemplated and within the scope of the disclosed technology.

I claim:

1. A therapeutic pillow, comprising:

a head support;

an elongated spine support extending outwardly from a substantially central point of a side of the head support, the elongated spine support coplanar with the head support;

a rigid support member disposed on a surface of the elongated spine support, the support member providing support to the elongated spine support; and a lower member extending perpendicularly outwardly from an end of the elongated spine support.

2. The therapeutic pillow of claim 1, further comprising:

a longitudinal axis extending through a center of a longitudinal length of the therapeutic pillow in a horizontal plane; and a vertical axis extending through a center of the longitudinal length of the therapeutic pillow in a vertical plane;

wherein:

the horizontal plane is normal to the vertical plane; and when a force is applied to the elongated spine support via the head support, the elongated spine support compresses into the support member, which bends the head support at an angle towards the vertical axis of the therapeutic pillow.

3. The therapeutic pillow of claim 2, wherein the force bends the elongated spine support along a middle section of the elongated spine support, which in turn bends an end of the elongated spine support that is connected to the head support at an angle towards the vertical axis of the therapeutic pillow, thereby bending the head support towards the vertical axis of the therapeutic pillow.

4. The therapeutic pillow of claim 1, wherein a force configured to be applied to the elongated spine support compresses the elongated spine support between the force and the support member, which compression bends the head support at an acute angle relative to either side of a point where the force most substantially compresses the elongated spine support wherein a front side of the head support is substantially planar with a non-planar a neck support protruding upwardly from the front side of the head support.

5. The therapeutic pillow of claim 1, wherein a force configured to be applied to the elongated spine support compresses the elongated spine support between the force and the support member, which compression bends the elongated spine support and the head support acutely towards each other substantially at a point where the elongated spine support and the head support join, thereby raising the spine of a user and lowering the shoulders of the user.

6. The therapeutic pillow of claim 1, further comprising a neck support protruding upwardly from a side of the head support that is attached to the elongated spine support.

7. The therapeutic pillow of claim 6, wherein the neck support defines an arch that arches away from the elongated spine support.

8. The therapeutic pillow of claim 1, wherein the head support, the elongated spine support, and the lower member each include cushioning.

9. The therapeutic pillow of claim 1, wherein the head support is rectangular.

10. The therapeutic pillow of claim 1, wherein the elongated spine support extends perpendicularly outwardly from a side of the head support.

11. The therapeutic pillow of claim 6, wherein the elongated spine support extends perpendicularly outwardly from the side of the head support that the neck support is disposed.

12. The therapeutic pillow of claim 11, wherein the elongated spine support includes a length greater than a length of the head support.

13. The therapeutic pillow of claim 12, wherein the elongated spine support is triangular.

14. The therapeutic pillow of claim 1, wherein the support member is a rigid member that provides a rigid support to the elongated spine support when a force is applied to the elongated spine support.

15. The therapeutic pillow of claim 1, wherein the support member is coextensive with the surface of the elongated spine support.

16. The therapeutic pillow of claim 1, wherein the lower member is pivotally connected to the elongated spine support.

17. A therapeutic pillow, comprising:

a head support;

an elongated spine support extending outwardly from the head support, the elongated spine support coplanar with the head support;

a support member disposed on a surface of the elongated spine support, the support member providing support to the elongated spine support; and a lower member extending perpendicularly outwardly from an end of the elongated spine support;

wherein the lower member is pivotally connected to the elongated spine support such that it is rotatable about a longitudinal axis of the elongated spine support.

18. The therapeutic pillow of claim 17, wherein the lower member is resilient about the elongated spine support, such that the lower member returns to its perpendicularly outward orientation after being pivoted.

19. The therapeutic pillow of claim 17, wherein the lower member includes an arching portion disposed on a distal end thereof, the arching portion including an arch that arches outwardly from the lower member.

20. A therapeutic pillow, comprising:

a head support;

an elongated spine support extending outwardly from a substantially central point of a side of the head support, the elongated spine support coplanar with the head support;

a rigid support member disposed on a surface of the elongated spine support, the support member providing support to the elongated spine support; and a lower member extending perpendicularly outwardly from an end of the elongated spine support;

wherein a width of the head support in a horizontal plane is greater than a width of the elongated spine support and/or a width of the rigid support member in a horizontal plane.

* * * * *